United States Patent [19]

Domenico

[11] 4,250,497

[45] Feb. 10, 1981

[54] VIBRATION-RESISTANT COUPLING FOR INSULATED ELECTRICAL CONDUCTOR

[75] Inventor: Frigo Domenico, Olmo, Italy

[73] Assignee: F.I.A.M.M. S.p.A. Fabbrica Italiana Accumulatori Motocarri Montecchio, Montecchio Maggiore, Italy

[21] Appl. No.: 965,275

[22] Filed: Dec. 1, 1978

[30] Foreign Application Priority Data

Nov. 2, 1977 [IT] Italy ..... 41720 A/77

[51] Int. Cl.[2] ..... G08B 3/10

[52] U.S. Cl. ..... 340/404; 339/97 R

[58] Field of Search ..... 340/404; 339/97 R

[56] References Cited

U.S. PATENT DOCUMENTS 4,074,929 2/1978 Krider ..... 339/97 R

*Primary Examiner*—Harold I. Pitts

*Attorney, Agent, or Firm*—Karl F. Ross

[57] ABSTRACT

An insulated wire subjected to mechanical vibrations, such as a supply lead for an electromagnetic coil of an automobile horn or other sound generator, is partly received in a groove of a conductive connector plate overlain by a conductive or nonconductive retaining plate. The groove has a width and a depth substantially corresponding to the diameter of the insulated wire but is constricted near its bottom, over part of its length, by one or two inwardly projecting ledges with sharp edges cutting into the insulation and contacting the bare wire which deforms into the narrowed groove portion, the cross-sectional area of the groove in its constricted part being substantially equal to that of the insulated wire.

10 Claims, 6 Drawing Figures

VIBRATION-RESISTANT COUPLING FOR INSULATED ELECTRICAL CONDUCTOR

FIELD OF THE INVENTION

My present invention relates to a vibration-resistant coupling for connecting a branch lead, an extension line or some other circuit component to an insulated electrical conductor.

BACKGROUND OF THE INVENTION

In many instances, particularly in the field of electromagnetic sound generators such as automobile horns, junctions between the electrical wiring and other components are repeatedly subjected to considerable vibrations, especially when positioned in the immediate vicinity of a source of mechanical oscillations. Conventionally, the conductors (which may be stranded or solid wires) are stripped of their insulation and soldered or brazed to an associated terminal; such connections, aside from being sensitive to vibration, tend to introduce an elevated resistance in view of the poor electrical conductivity of the bonding material. Often, the cutting of the insulating layer prior to stripping damages the underlying conductor core which may thereby be seriously weakened.

OBJECTS OF THE INVENTION

The general object of my present invention is to provide an improved coupling of the character referred to which obviates the aforestated problems and which does not require any soldering or brazing operation.

A more particular object is to provide a vibration-resistant connection between an electromagnetic coil of a sound generator and other circuit elements such as, for example, an associated interrupter contact.

SUMMARY OF THE INVENTION

In accordance with my present invention, an insulated electrical conductor of substantially circular cross-section has an end or other portion of limited length received in an open-ended groove on a face of a connector plate of electrically conductive material, the width of the groove adjacent that face and its depth transverse thereto being both substantially equal to the diameter of the coated conductor. The groove is constricted, at a level between its bottom and the plate face referred to, by an internal projection integral with the plate cutting into the insulated coating and contacting the core of the conductor whose inserted portion is held in position by retaining means overlying that face.

Advantageously, in order to insure firm conductive contact between the connector plates and the inserted conductor, the cross-sectional area of the groove in the region of its internal projection substantially equals the cross-sectional area of the conductor, including its coating, which under pressure of the overlying retaining means become deformed so as completely to occupy the restricted part of the groove.

Pursuant to a more particular feature of my invention, the internal projection is formed by two confronting sharp-edged ledges rising from the groove bottom to cut into the insulation when the conductor is pressed down into the groove.

In order to afford the conductor a certain flexibility in the immediate vicinity of its clamped portion, the groove advantageously extends in one or both directions beyond the aforementioned ledges with a substantially square cross-section and terminates in one or two outwardly flared extremities of substantially semicircular cross-section.

BRIEF DESCRIPTION OF THE DRAWING

The above and other features of my invention will now be described in detail with reference to the accompanying drawing in which.

SPECIFIC DESCRIPTION

Figure 1:
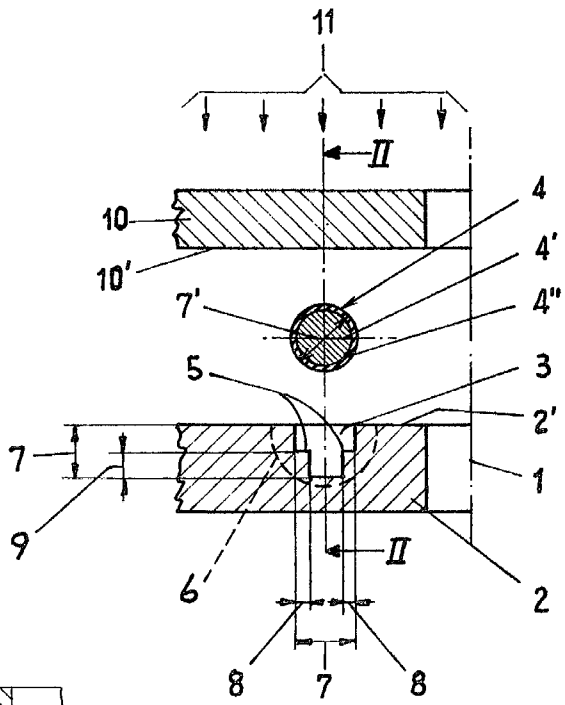
FIG. 1 is a fragmentary sectional view, taken on the line I—I of FIG. 2, of a grooved connector plate and an associated retaining plate together with an insulated conductor to be engaged thereby.
Figure 2:
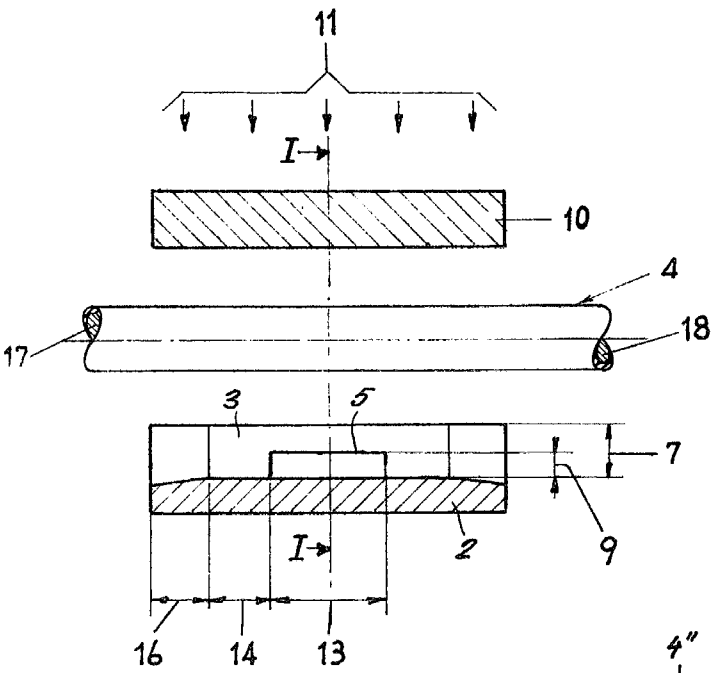
FIG. 2 is a cross-sectional view taken on the line II—II of FIG. 1.

In FIGS. 1 and 2 I have shown a pair of coacting metallic plates 1 and 2, with respective bores centered on an axis 1 for the passage of a clamping bolt or a rivet, designed to be galvanically coupled with a conductor 4 comprising a metallic core 4' surrounded by an insulating coating 4''. Core 4', e.g. a copper wire or a twisted cable composed of a multiplicity of copper strans, is shown to be of circular cross-section; the entire conductor, including its coating 4'', has a diameter 7'. A face 2' of connector plate 2, confronting a face 10' of retaining plate 10, is formed with a groove 3 which extends between opposite plate edges so as to have two open ends formed by part-frustoconical extremities 16 whose substantially semicircular cross-section 6 can be seen in FIG. 1.

Figure 1A:
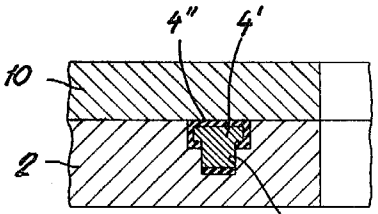
FIG. 1A shows the conductor of FIG. 1 received in the groove of the connector plate and clamped therein by the retaining plate.

These extremities merge into adjoining groove portions 14 of square cross-section having a width and a depth 7 equal to the conductor diameter 7'. Two sharp-edged ledges 5 project inwardly from opposite walls over a central part 13 of the groove having a T-shaped profile as seen in FIGS. 1 and 1A. Ledges 5 have a width 8 exceeding the thickness of insulation 4'' and a height 9 which may range between about one-fourth and three-fourths of diameter 7' and is here shown to equal about half that diameter and therefore half the depth 7. The cross-sectional areas of this groove portion 13 substantially equals that of the conductor 4 whereby the latter, upon being urged into the groove 3 of connector plate 2 by the retaining plate 10 under a pressure indicated by arrows 11, undergoes a plastic deformation which forces its conductive core 4' into close contact with the laterally projecting ledges 5 as seen in FIG. 1A. Retaining plate 10, which need not be conductive, may be a washer centered on axis 1, for example.

The undeformed sections 17 and 18 of conductor 4 fit closely into the groove portions 14 of square outline and are free to flex to a limited extent in the adjoining groove extremities 16. The transition zones between groove portions 14 and 16 may be rounded to avoid any cutting into the conductor core.

It will be evident that the conductor 4 could terminate short of one of the extremities 16 of the groove which in that case might be closed at one end.

Figure 3:
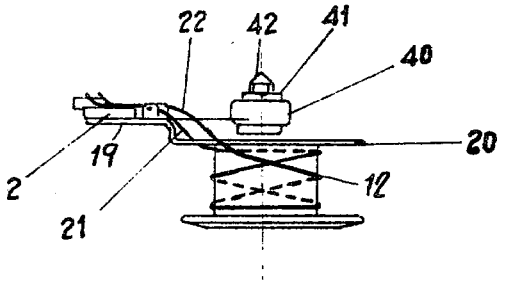
FIG. 3 is a side view of an electromagnetic coil, forming part of a sound generator such as an automobile horn, provided with a coupling of the type illustrated in the preceding Figures.
Figure 4:
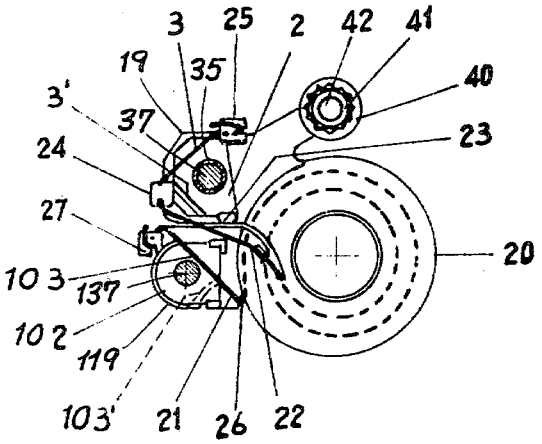
FIG. 4 is a top view of the assembly shown in FIG. 3.
Figure 5:
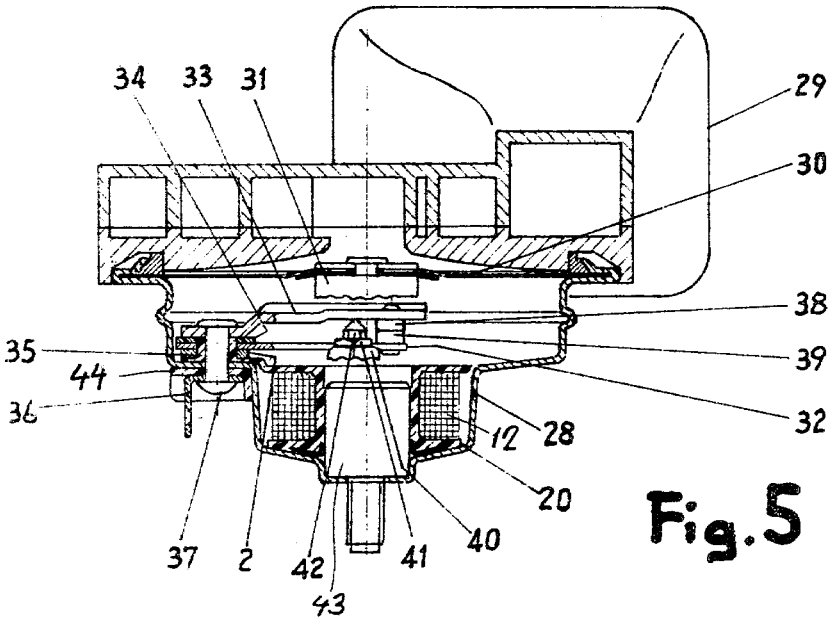
FIG. 5 is an elevated view, in axial section, of an entire sound generator incorporating the assembly of FIGS. 3 and 4.

In FIGS. 3–5 I have shown an electromagnetic sound generator for an automotive vehicle or the like, similar to those disclosed in my copending application Ser. No. 765,077 filed Feb. 3, 1977, now U.S. Pat. No. 4,134,200 issued Jan. 16, 1979, and a subsequent application Ser. No. 962,156 filed Nov. 20, 1978, incorporating a wire coupling of the type illustrated in FIG. 1A. According to FIGS. 3 and 4, an electromagnetic coil 12 wound on a spool-shaped dielectric carrier 20 has a pair of insulated terminal leads 21, 22 partly received in respective grooves 103, 3 of a pair of connector plates 102, 2 supported on extensions 119, 19 of the upper cheek of carrier 20. Groove 103, not shown in detail, is of the same basic configuration as groove 3, as are two other grooves 3', 103' on plates 2 and 102 designed to accommodate conductors of different diameters in the event that a different electromagnetic coil is employed. In this particular instance, groove 3' has been shown provided on the same face of groove 3 on plate 2 whereas groove 103' is disposed on the face of plate 102 opposite the one bearing the groove 103. The latter plate, therefore, ought to be reversed on its support when it is desired to substitute groove 103' for groove 103.

Plates 2, 102 and their supports 19, 119 are traversed by respective rivets 37, 137 serving to clamp the associated retaining elements onto them, these elements having been omitted in FIG. 4. The retaining element coacting with connector plate 102 may be an extension of the grounded generator housing 28 (FIG. 5). Lead 21, lodged in groove 103, is engaged by grippers 26 and 27 in line with that groove so as to lie flush with the upper surface of plate 102. Similar grippers 24, 25 are disposed at opposite ends of groove 3 at the level of the upper surface of plate 2. It will be apparent that, if groove 3' is to be used in lieu of groove 3, plate 2 would have to be rotated clockwise about its rivet 37 through an angle of about 90°.

The lug 19 supporting the plate 2 forms an insulating sleeve 35 around the rivet 37 overlain by an insulating strip 34. A cantilevered metallic arm 33, supporting an interrupter contact 38 as shown in FIG. 5, rests on the strip 34 and is conductively engaged by the upper head of rivet 37. Contact 38 coacts with another contact 39 carried on a leaf spring 32 which is secured, in a manner more fully illustrated in my above-identified application Ser. No. 765,077 and U.S. Pat. No. 4,134,200, to an armature 31 attractable by an electromagnetic coil 12, this armature being mounted on an oscillatory membrane 30 clamped between the generator housing 28 and an overlying resonator 29. Armature 31, shown partly broken away in FIG. 5, terminates within coil 12 just above a stationary core 43 as likewise disclosed in my last-mentioned application and patent. Spring blade 32 is clamped by the rivet 37 through the intermediary of strip 34 into firm contact with the connector plate 2 and thus plays the part of the retaining plate 10 shown in FIGS. 1 and 2. The lower head of the rivet engages a terminal 36, separated from housing 28 by another insulating strip 44, through which power may be supplied to coil 12 in series with interrupter contacts 38, 39 from a nonillustrated source whose current passes from terminal 36 via rivet 37, arm 33, contacts 38, 39, spring 32, plate 2, lead 22, coil 12, lead 21 and plate 102 to the grounded pole of the source.

Lug 19 extends beyond plate 2 to support an eccentric pad 40 traversed by a bolt 42 which is engaged by a nut 41 above that pad and serves for the tuning of the sound generator by raising or lowering the resilient arm 33 and its interrupter contact 38 with reference to the coil 12, in a manner generally similar to that described in my application and patent last referred to.

It will thus be seen that my present improvement not only provides a safe and vibration-resistant electrical connection but also significantly simplifies the assembly of a sound generator of the type disclosed in my prior applications and patent identified above.

I claim:

1. In combination, an electrical conductor of substantially circular cross-section having a conductive core provided with an insulating coating and a coupling forming an electrical extension of said conductor, said coupling comprising:

a connector plate of electrically conductive material provided with an open-ended groove on a face of said plate, said groove having a width adjacent said face and a depth transverse thereto both substantially equaling the diameter of said conductor and its coating, said conductor having a portion of limited length received in said groove, the latter being constricted at a level between its bottom and said face by an internal projection integral with said plate cutting into said coating and contacting said core; and retaining means overlying said face for holding said portion of said conductor in said groove.

2. The combination defined in claim 1 wherein said groove in the region of said projection has a cross-sectional area substantially equaling that of said conductor including its coating.

3. The combination defined in claim 1 or 2 wherein said projection comprises a pair of confronting sharp-edged ledges rising from the groove bottom.

4. The combination defined in claim 3 wherein said groove extends in at least one direction beyond said ledges with a substantially square cross-section and terminates in an outwardly flared extremity of substantially semicircular cross-section.

5. The combination defined in claim 1 or 2 wherein said conductor is a lead of an electromagnetic coil forming part of a sound generator.

6. The combination defined in claim 5 wherein said coil is wound on a carrier having a cheek, said connector plate being supported on an extension of said cheek.

7. The combination defined in claim 6 wherein said cheek is provided with retaining means in line with said groove engaging said lead.

8. The combination defined in claim 7 wherein said connector plate is provided with a second groove, having a conductor-engaging constriction, differing in width from the first-mentioned groove.

9. The combination defined in claim 8 wherein said grooves are disposed at opposite faces of said connector plate and are alternately alignable with said retaining means upon a reversal of said connector plate on said extension.

10. The combination defined in claim 6 wherein said sound generator includes a pair of interrupter contacts in series with said coil, one of said contacts being carried on an armature coacting with said coil and being conductively linked with said lead via said connector plate, the other of said contacts being mounted on a support displaceable by tuning means carried on said cheek.

* * * * *

UNITED STATES PATENT AND TRADEMARK OFFICE

CERTIFICATE OF CORRECTION

PATENT NO. : 4,250,497

DATED : 10 February 1981

INVENTOR(S) : Frigo Domenico

It is certified that error appears in the above-identified patent and that said Letters Patent are hereby corrected as shown below:

In the heading, left column, item [75], change the name of the inventor to read:

-- DOMENICO FRIGO --;

left column, item [30], change the date of the foreign application to:

-- December 2, 1977 --.

Signed and Sealed this

Sixteenth Day of June 1981

[SEAL]

*Attest:*

RENE D. TEGTMEYER

*Attesting Officer*

*Acting Commissioner of Patents and Trademarks*